US005967072A

United States Patent [19]

Leary

[11] Patent Number: 5,967,072

[45] Date of Patent: Oct. 19, 1999

[54] DEEP DRAFT-SHALLOW DRAFT CARGO VESSEL

[76] Inventor: John H. Leary, 1301 Leontine St., New Orleans, La. 70115

[21] Appl. No.: 08/982,602

[22] Filed: Dec. 2, 1997

Related U.S. Application Data

[60] Provisional application No. 60/052,060, Jul. 9, 1997.

[51] Int. Cl.[6] ..... B63B 1/14

[52] U.S. Cl. ..... 114/77 R; 114/73

[58] Field of Search ..... 114/26, 29, 77 R, 114/353, 61, 73, 61.15

[56] References Cited

U.S. PATENT DOCUMENTS

| | | | |
|---|---|---|---|
| 278,829 | 6/1983 | Stierle . | |
| 322,409 | 7/1985 | Barney . | |
| 2,444,299 | 6/1948 | Koenig | 114/29 |
| 3,054,267 | 9/1962 | Alcorn et al. | 114/32 |
| 3,688,722 | 9/1972 | Van Der Werff | 114/29 |
| 4,531,469 | 7/1985 | Brouwer | 114/29 |

FOREIGN PATENT DOCUMENTS

| | | | |
|---|---|---|---|
| 1340282 | 5/1964 | France . | |
| 119933 | 7/1970 | Norway . | |
| WO89/02390 | 9/1988 | WIPO | B63B 43/14 |
| WO92/16405 | 3/1992 | WIPO . | |

*Primary Examiner*—Sherman Basinger

*Attorney, Agent, or Firm*—Garvey, Smith, Nehrbass & Doody, LLC

[57] ABSTRACT

A vessel which can convert from a deep draft configuration to a shallow draft configuration. The vessel would include a principal hull portion having an outer wall extending the length of the hull portion and defining an internal cargo holding space therein; vertical members, defining together a center wall, extending the length of the hull and dividing the hull into a pair of cargo bays along its entire length; a plurality of transverse bulkheads spaced apart along the lengths of the hull for further dividing the cargo bays into a plurality of cargo holds or tanks on either side of the center line wall; a hinge member positioned at the lower point of the central members which would allow each member to move from a first vertical position, defining the deep draft vessel hull configuration, down to a second position defining the shallow draft hull position, each of the halves of the hull further including an upper deck for maintaining any cargo within the cargo space defined by the hull walls; cargo hatches with opening covers along the upper deck for allowing the loading and unloading of cargo therefrom; and a pump for allowing water or the like fluid to be injected into the hull while the vessel is in the shallow draft configuration so as to serve as ballast in moving the hulls into the deep draft configuration; a hydraulic ram system for securing the first and second halves of the hull when the first and second halves of the hull are moved upwardly into the deep draft configuration, so that the hull is able to travel through open seas.

16 Claims, 7 Drawing Sheets

DEEP DRAFT-SHALLOW DRAFT CARGO VESSEL

CROSS-REFERENCE TO RELATED APPLICATIONS

Priority of U.S. Provisional patent application Ser. No. 60/052,060, filed Jul. 9, 1997, incorporated herein by reference, is hereby claimed.

REFERENCE TO A "MICROFICHE APPENDIX"

Not applicable

STATEMENT REGARDING FEDERALLY SPONSORED RESEARCH OR DEVELOPMENT

Not applicable

BACKGROUND OF THE INVENTION

1. Field of the Invention

The apparatus of the present invention relates to cargo vessels. More particularly, the present invention relates to a cargo vessel that may convert from a deep draft, deep sea vessel for transport of cargo, into a shallow draft vessel for transporting cargo in relatively shallow bodies of water such as navigable rivers or the like.

2. General Background of the Invention

In the transport of cargo throughout the world, cargo must often be transported in various types of vessels depending on the depth of the water in which the vessel travels. For example, when grain from the Midwest is harvested for transport to foreign countries, the grain must be placed in relatively shallow vessels such as barges or the like and moved down river, such as the Mississippi River, to grain elevators where the grain is then unloaded from the barges, into the grain elevators. Subsequently a deep draft vessel, such as a cargo ship, is then loaded with the grain so that the ship may then transport the grain cargo to foreign ports. Most grain elevators would be located for example, between New Orleans and Baton Rouge, since any travel north of Baton Rouge by a deep draft vessel is impossible because of the shallow depth of the Mississippi River. Even on the occasion where the deep draft vessel can receive the cargo of grain directly from the shallow draft barge, again time and effort and expenses are incurred when this transfer is undertaken.

Therefore, there is a need in the art for a vessel which may be converted from a deep draft vessel which is capable of carrying cargo, such as grain, or other dry bulk cargo, or liquid bulk cargo, through the oceans into foreign ports, and yet may be converted into a shallow draft vessel, so that the vessel may be moved up a relatively shallow waterway such as the Mississippi River. Therefore, as the deep draft vessel moves up the river, it could be converted into a shallow draft vessel, which could then be loaded with grain for example, in St. Louis, and travel down the Mississippi until such time as it is able to reconvert to a deep draft vessel, and then be moved into the open seas for transport to foreign ports.

BRIEF SUMMARY OF THE INVENTION

The apparatus of the present invention solves the problems in the art in a simple and straightforward manner. What is provided is a vessel which can convert from a deep draft configuration to a shallow draft configuration. The vessel would include a principal hull portion having an outer wall extending the length of the hull portion and defining an internal cargo holding space therein; vertical members, defining together a center wall, extending the length of the hull and dividing the hull into a pair of cargo bays along its entire length; a plurality of transverse bulkheads spaced apart along the lengths of the hull for further dividing the cargo bays into a plurality of cargo holds or tanks on either side of the center line wall; a hinge member positioned at the lower point of the central members which would allow each member to move from a first vertical position, defining the deep draft vessel hull configuration, down to a second position defining the shallow draft hull position, each of the halves of the hull further including an upper deck for maintaining any cargo within the cargo space defined by the hull walls; cargo hatches with opening covers along the upper deck for allowing the loading and unloading of cargo therefrom; and a means for allowing water or the like fluid to be injected into the hull while the vessel is in the shallow draft configuration so as to serve as ballast in moving the hulls into the deep draft configuration; means for securing the first and second halves of the hull when the first and second halves of the hull are moved upwardly into the deep draft configuration, so that the hull is able to travel through open seas.

It is therefore a principal object of the present invention to provide a vessel which can convert from a deep draft cargo vessel to a shallow draft cargo vessel so as to allow the vessel to move through both deep water and shallow water during transport of cargo.

It is a further principal object of the present invention to provide a cargo vessel which may convert very easily from a deep draft cargo vessel to a shallow draft cargo vessel so that in the deep draft configuration the vessel maintains its stability while in the open seas, and in its shallow draft configuration, allows the vessel to travel in relatively shallow water such as a barge or the like.

It is a further object of the present invention to provide a cargo vessel which may convert between a deep draft vessel and a shallow draft vessel, while the vessel is filled with cargo or while the vessel is empty.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
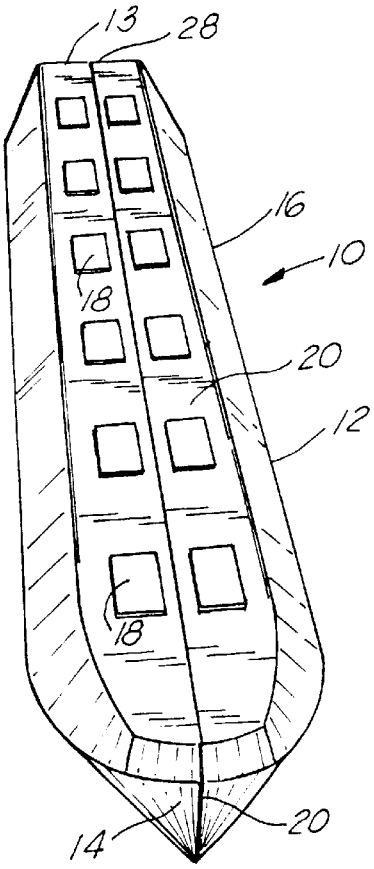
FIG. 1 is an overall perspective view of the vessel looking aft in the deep draft configuration.
Figure 7:
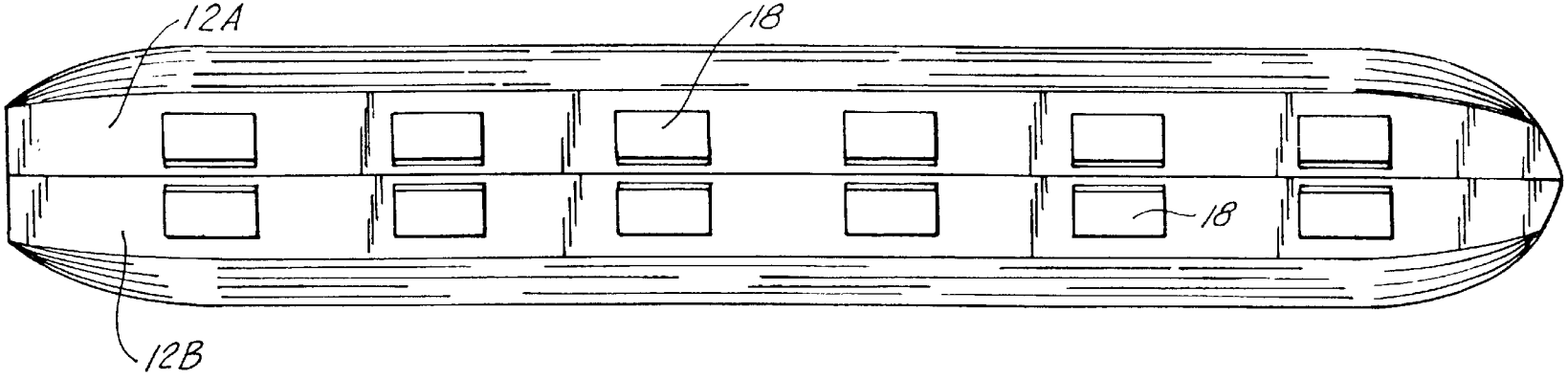
FIGS. 7 and 8 are top and side views respectively of the vessel in the deep draft configuration.
Figure 8:
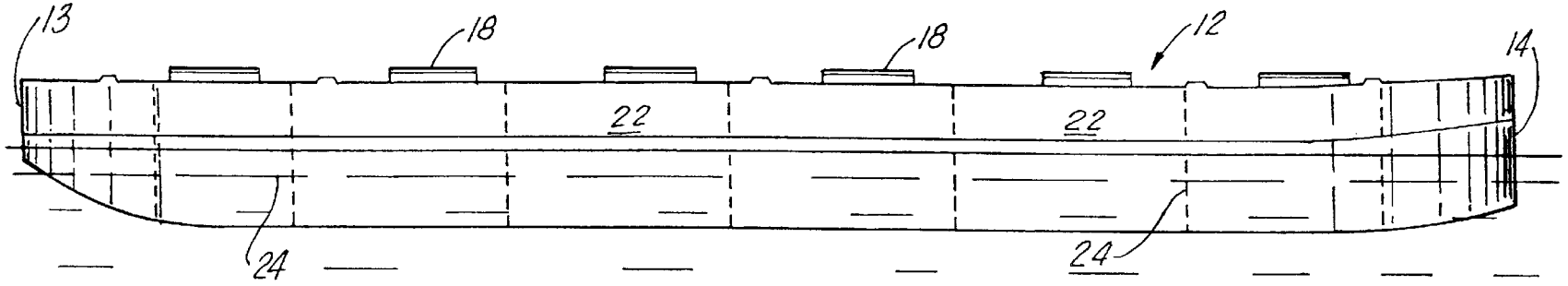

FIGS. 1–13 illustrate the preferred embodiment of the apparatus of the present invention by the numeral 10. Initially, reference will be made to FIGS. 1–8 which particularly show the exterior of the vessel hull and the components which define the exterior of the vessel 10, both in the deep draft configuration and in the shallow draft configuration, as will be described further. As seen, for example in the FIGS. 1–8, vessel 10 is illustrated having a general longitudinal hull portion 12 extending from its forward end 14 to its truncated aft end 13, the vessel for the most part in the preferred embodiment, having the ability to be configured from a shallow draft vessel as seen in overall and side views in FIGS. 2, 5 and 6, to a deep draft vessel as seen in FIGS. 1, 7 and 8. The vessel, either configured as a shallow draft or deep draft vessel, would have the ability to be a towable vessel such as a barge or the like, or may be pushed in its movement by, for example, a tug boat, or may be equipped with machinery for self-propulsion.

Turning now to the configuration of the vessel 10 as it appears on the exterior in the deep draft configuration, reference is made to FIG. 1 where vessel 10 would have a continuous side wall 16 which would extend again from the forward end 14 to the aft end 13 of the vessel with the pair of side walls 16 defining an interior cargo space within the vessel. Further, as seen in FIGS. 1, 7 and 8, the vessel, in the deep draft configuration would include a plurality of exterior cargo hatches 18 which are spaced along the top surface 20 of the vessel 10 each of the hatches opening into individual cargo holds or tanks 22 formed along the length of hull 12, as seen by phantom lines 24 in FIGS. 6 and 8. Each of the hatches 18 would have the ability to open for loading or unloading in either the deep draft or shall draft configurations.

Figure 2:
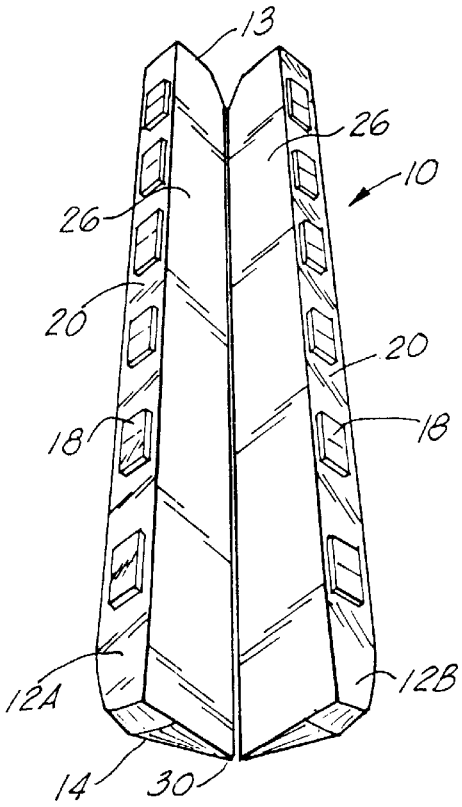
FIG. 2 is an overall view of the vessel looking aft in the shallow draft configuration.
Figure 3:
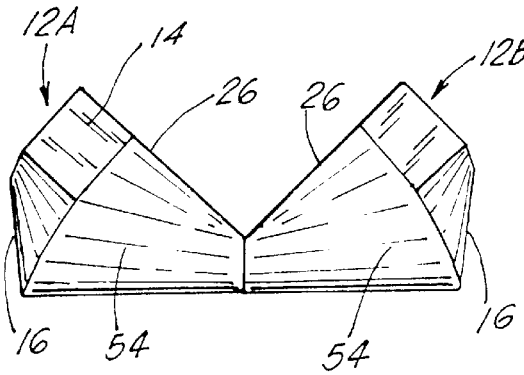
FIGS. 3 and 4 are front and rear views respectively of the vessel in the shallow draft configuration.
Figure 4:
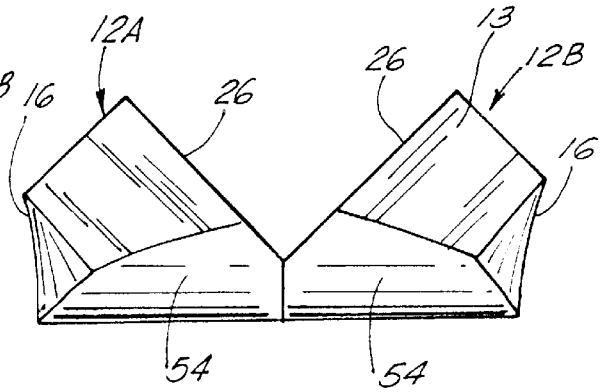
Figure 5:
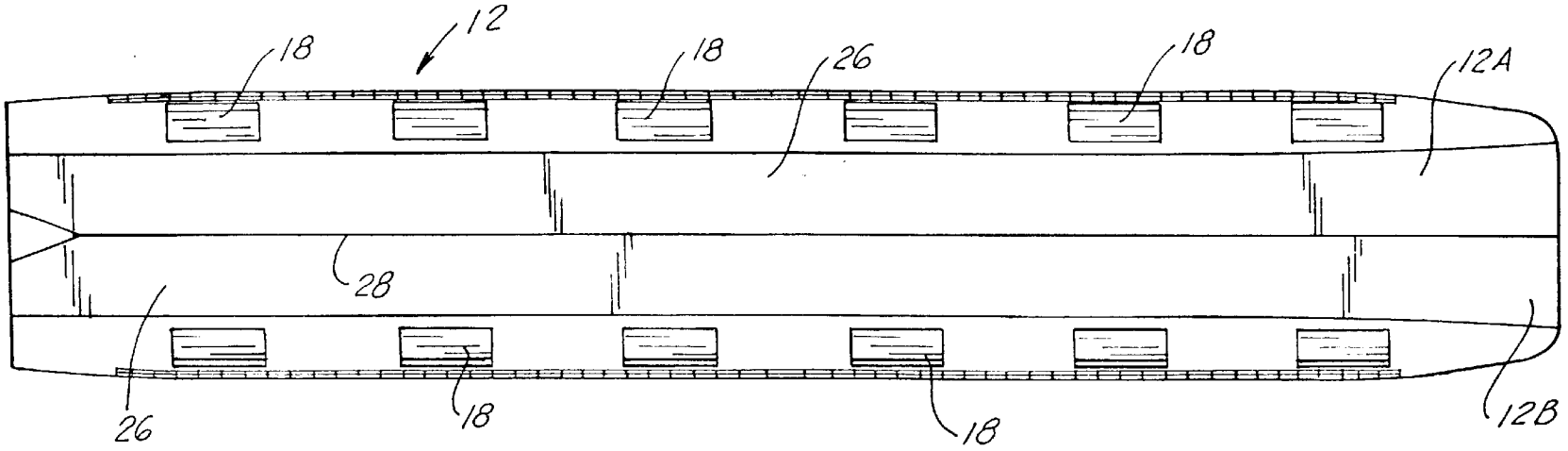
FIGS. 5 and 6 are top and side views respectively of the vessel in the shallow draft configuration.
Figure 6:
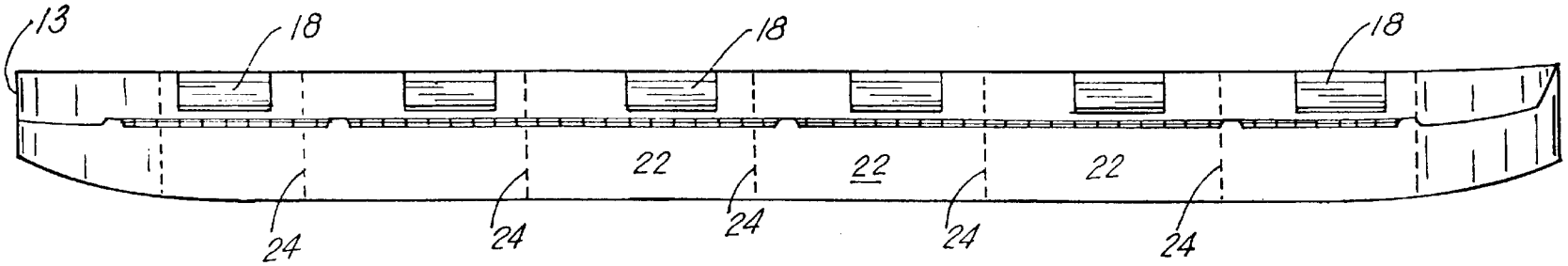

Turning now to the vessel itself, vessel 10 is illustrated in the shallow draft configuration in FIGS. 2, 5 and 6. As illustrated for example in FIGS. 2 and 5, the vessel includes central dividing members 26, which extend from the forward end 14 of the vessel down the center line 28 of the vessel and terminating at point 30. While in this configuration as illustrated in FIG. 5, each of the central dividing members 26 would in effect divide the cargo holds 22 into two halves along the length of the vessel 10. It is further provided that aft end 13 of the vessel, either in the deep draft or shallow draft configuration, as illustrated for example in FIGS. 6 and 8, would be configured with a truncated end 13 so as to allow a vessel, such as a tug boat to push the vessel either in the deep draft or shallow draft configuration. As stated earlier, the series of transverse phantom lines 24 which define a plurality of transverse bulk heads, divide the space within the vessel into a plurality of cargo holds 22, as illustrated. These cargo hatches 18, would be completely horizontal as illustrated for example in FIGS. 7 and 8 when the vessel 10 is in the deep draft configuration, to an angulated position as seen in FIGS. 5 and 6, when the vessel 10 is in the shallow draft configuration. In either configuration these cargo hatches 18 would enable cargo to be loaded in and out of the vessel 10, yet would prevent cargo from flowing out of the cargo holds 22 when the cargo hatches 18 are in the open position.

Figure 9:
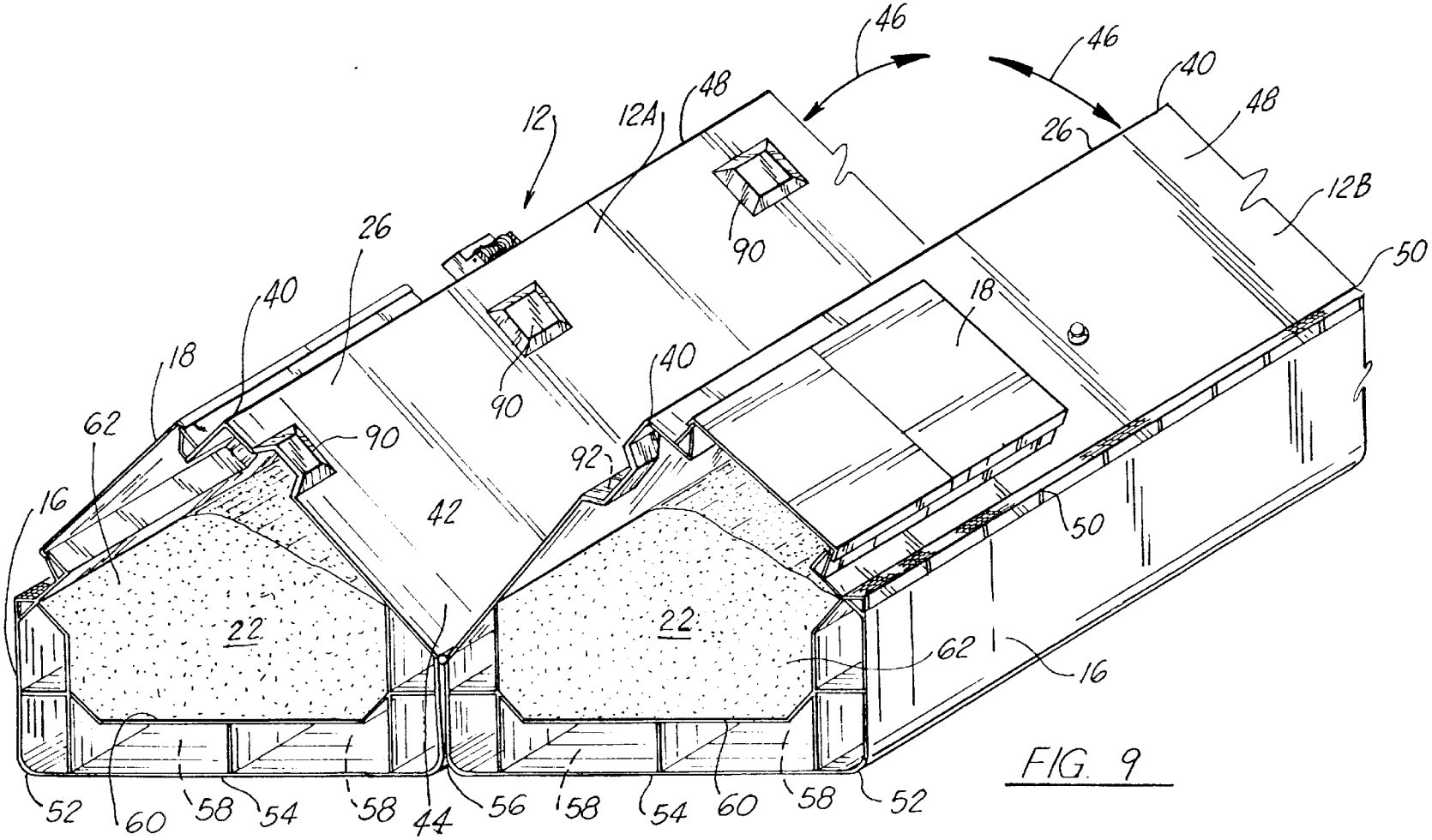
FIG. 9 is an overall cut away view of the hull portions of the vessel in the shallow draft configuration as the cargo holds are filled with product.
Figure 10:
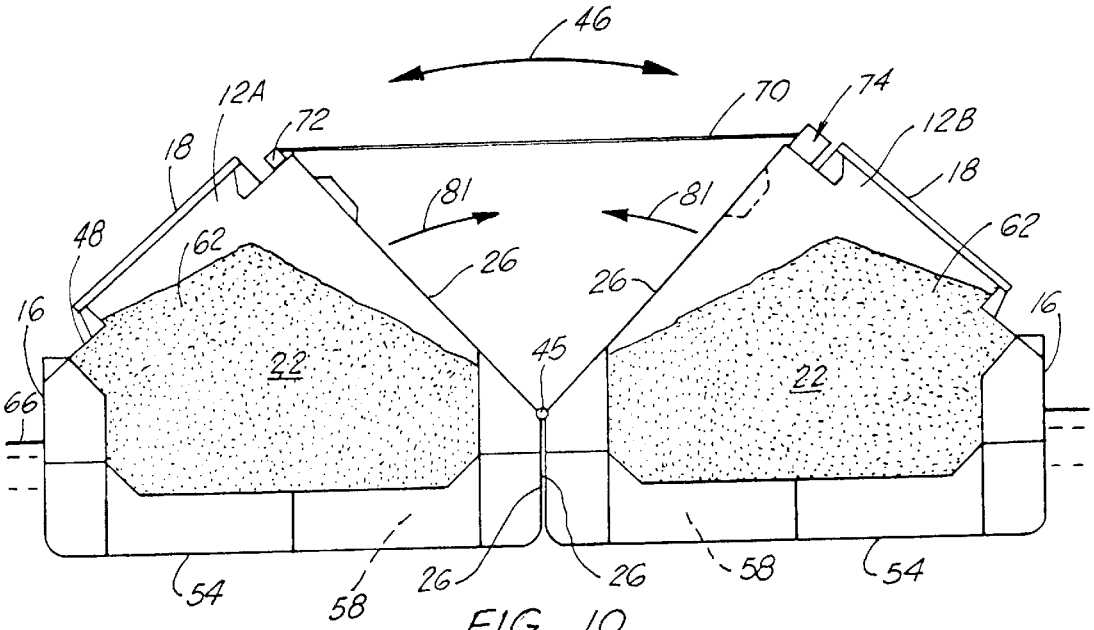
FIG. 10 is a cross-section view of the vessel in the shallow draft configuration as the vessel is being prepared for reconfiguration into the deep draft configuration.

FIGS. 9 through 12 illustrate in cross-section view, the overall configuration of the hull portion 12 and its components as the hull portion 12 is positioned either in the shallow draft configuration or the deep draft configuration, in its ability to configure from one of the two configurations. For example, as illustrated in FIG. 9, the entire hull portion 12 is seen in the shallow draft configuration, with the hull 12 actually divided into a first hull portion 12A and a second hull portion 12B. As illustrated, as was stated earlier, each of the hull portions 12A and 12B which make up the entire hull 12 includes a pair of interior central dividing center line members 26 which, in the shallow draft configuration as seen in FIG. 9, define the interior angulated walls of each of the hull portions 12A, 12B. Each of the members 26 terminate at an upper point 40, and at a lower point 42, where each of the members 26 are hinged along a common edge 44 via hinge assembly 45, as seen in FIG. 10. This assembly 45 facilitates the movement of the hull portions 12A, 12B in the direction of arrows 46, as seen in FIG. 9. At the apex point 40 of member 19, there is provided the upper deck portion 48 of each of the hull portions 12A, 12B, where upon each of the cargo hatches 18 are mounted. The lower edge 50 of the upper deck 48, would define an angle with each of the side walls 16 of each of the hull portions 12A, 12B as illustrated.

It should be noted in FIG. 9 that each of the side walls 16 form a corner 52 and terminate in a lower floor portion 54, which then forms a second upright interior wall 56, to configure with the inner wall 26 at the juncture at hinge 45 as was described earlier. As illustrated in FIG. 9, this particular portion of each of the hulls 12A, 12B, i.e. the side walls 26, lower floor portion 54 and interior side wall 56, are doubled hull walls, for defining an interior space 58 therebetween, with the upper surface 60 of the double hull portion defining the floor of the cargo hold 22, as seen in FIG. 9 filled with cargo 62. Of course the double hull arrangement of the vessel, as illustrated in FIG. 9, would provide that should the vessel 10 make contact with an object such as another vessel or an object in the water, that it may pierce the outermost skin of the vessel, yet would not cause a rupture of the vessel wall which may allow water to be taken into the cargo holds 22 which would contaminate the material within the vessel 10 or worse yet, sink the vessel should sufficient water get into the vessel.

Figure 11:
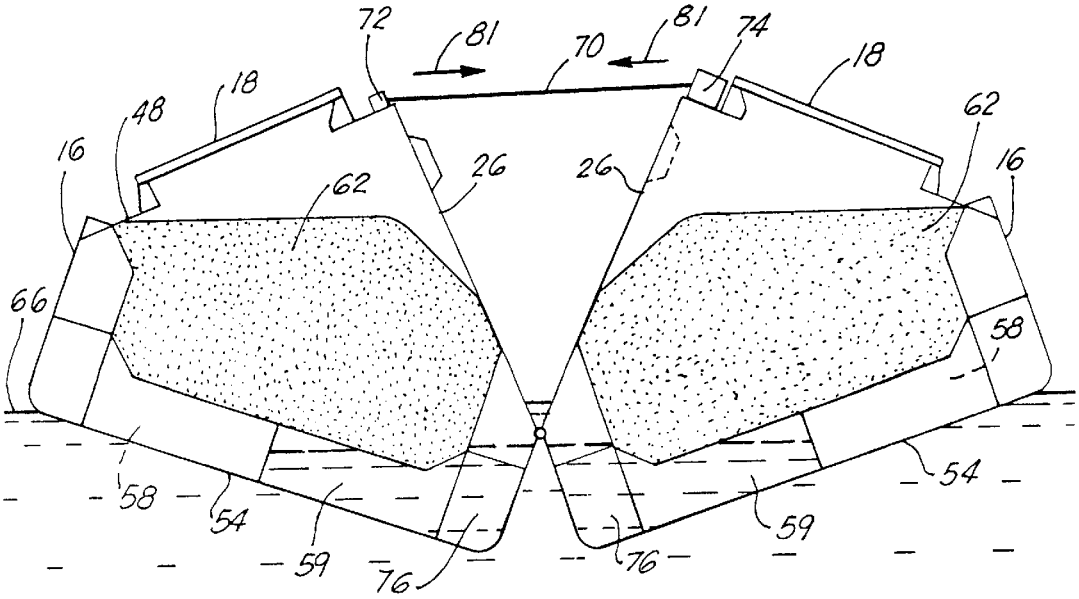
FIG. 11 is a cross-section view of the vessel of the present invention in the process of being configuration from the shallow draft to the deep draft configuration.

Turning now to FIGS. 10 and 11, reference is made first to FIG. 10, where each of the hull portions 12A and 12B again are configured in the shallow draft configuration, as seen with the water level 66 being up to a level along a portion of each of the side walls 16 and each of the cargo holds 22 being filled full with cargo 62, as illustrated. As seen more clearly, the hinge assembly 45 which is secured to each of the interior walls 26 at their lowermost point, where each of the hull portions 12A, 12B are allowed to move in the direction of arrow 46, as was illustrated in FIG. 9. The means for facilitating this movement of the hull portions 12A and 12B from the shallow draft configuration to the deep draft configuration would, for example, include a cable or the like 70 extending between a first connection point 72 on hull portion 12A, to, for example, an assembly 74 on hull portion 12B, which may include a motor and a winch upon which cable 70 may be wound. Since the cargo holds 22 of each of the hull portions 12A and 12B are filled, it is necessary that there be a means for encouraging the movement of the hull portions 12A and 12B inward to form the deep draft configuration. In order to accomplish this, reference is made to FIG. 11, where water 59 has been pumped into the interior space 58 as defined by the double hulls, so that as the water is pumped in, as seen in FIG. 11, the weight of the water serves as ballast that would tend to sink the interior corners 76 of each of the hull portions 12A, 12B, and would facilitate in each of the interior walls 26, moving inward toward one another, as the assembly 74 would pull the cable 70 to move hull portions 12A and 12B in the direction of arrow 81 as illustrated.

Figure 12:
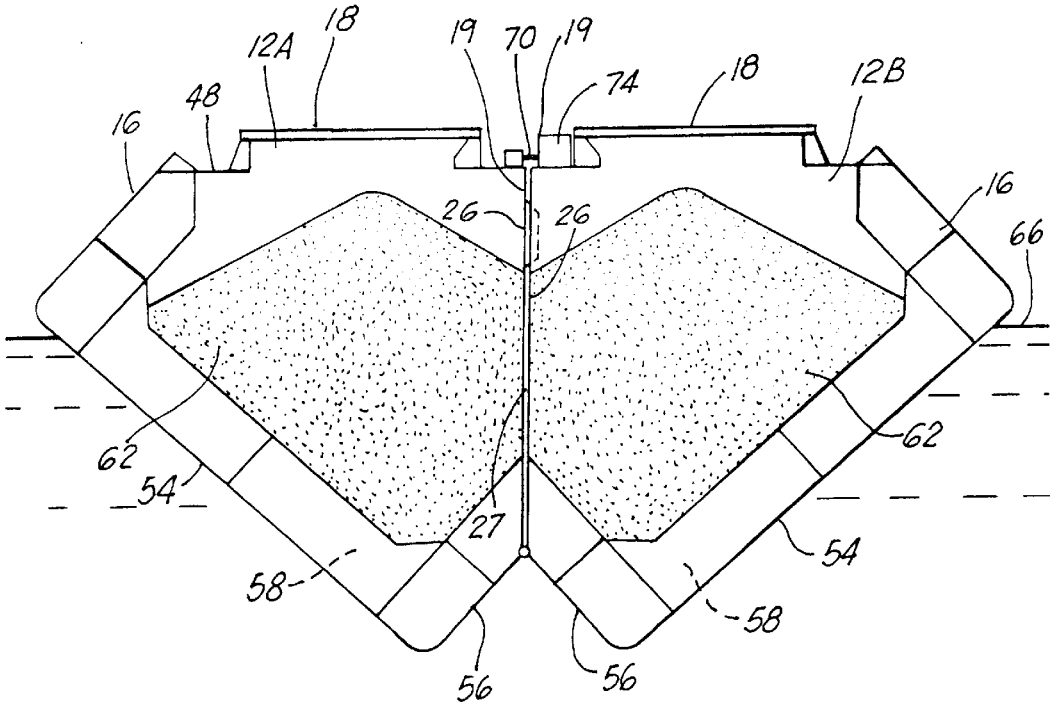
FIG. 12 illustrates an overall perspective cut away view of the vessel in the deep draft configuration with the cargo holds filled with product.

FIG. 12 would illustrate the completion of the movement of the hull portions 12A and 12B into the position so that interior walls 26 are adjacent one another. It would be in this configuration where the vessel would be in the deep draft configuration. As illustrated, the assembly 74 has pulled the cable 70 to its shortest length in forming a composite wall 27 between the two sections 12A and 12B. In this configuration as illustrated, the cargo hatches 18 are in the horizontal position, with the side walls 16 being angulated therefrom or from the upper wall 19 of each of the hulls 12A and 12B, and the lowermost floor portion 54 that was completely horizontal in the shallow draft configuration, as seen in FIG. 10, has now formed an angle from the horizontal to serve as the principal angulated side walls of the vessel 10 while it is in the deep draft configuration. It should be further noted that the lower interior walls 56 have formed an angle from one another, and define a lower channel 82, which is seen in FIG. 12, as the vessel 10 would be moved through the water in the deep draft configuration. One point to make is that after walls 26 have been moved into the vertical position adjacent one another to form the composite wall 27, as illustrated in FIG. 12, the ballast water 59 which was pumped into a portion of the lower chambers 58 defined by the double hull portion, would then be pumped out of the hull portion so that the double hull portion chambers would be empty as illustrated in FIG. 12. Further, it is foreseen that following the movement of the hulls 12A and 12B to form the composite hull portion 12, there may be included a hydraulic ram system 71, as seen in FIGS. 7 and 8 positioned on the upper portion 19 of hull portion 12 to form a locking system between hull portions 12A, 12B so as to assure that the hull portions 12A and 12B remain locked together in the composite hull 12 as seen also in FIG. 12.

Figure 13A:
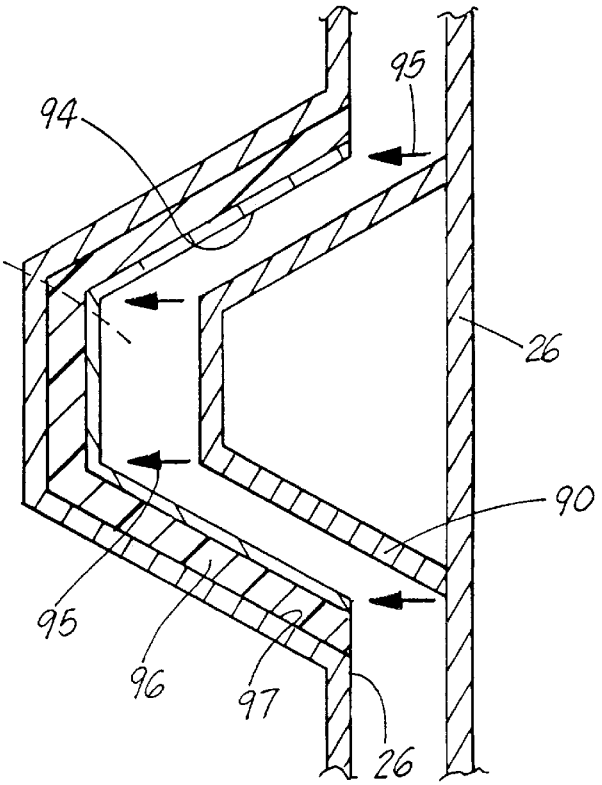
FIGS. 13A and 13B illustrate the assembly for maintaining the rigid alignment between the two halves of the vessel hull while it is in the deep draft configuration.
Figure 13B:
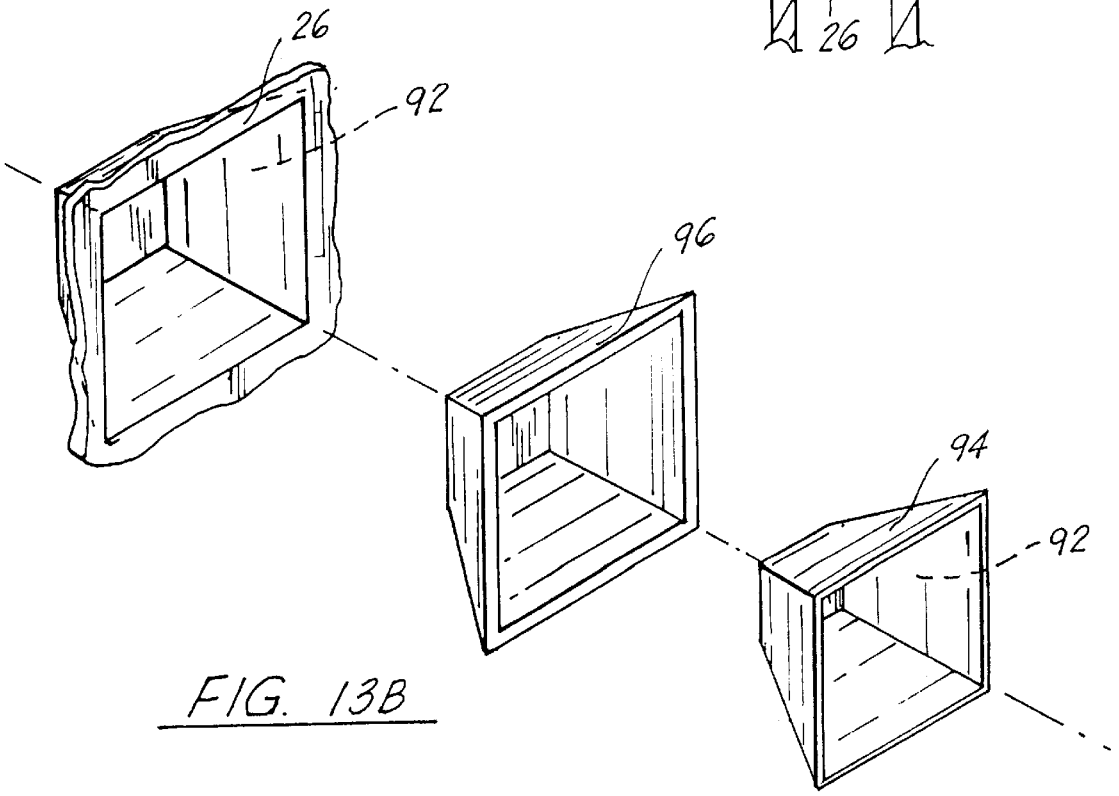

Reference is made now to FIGS. 13A and 13B which are isolated views of the means by which the hull portions 12A and 12B are affixed to one another on a rigid configuration when the vessel hull portions 12A and 12B have been moved to the position as seen in FIGS. 12 and 14. This means would include first a substantially truncated pyramid member 90 extending from the outer surface of wall 26 and spaced apart its length as seen in partial view in FIG. 9. Likewise, the second wall 26 would include a truncated recess 92 whose outer wall 94 would configure substantially to the shape, size and opening as the truncated pyramid 90. As the walls 26 would mate into the position as seen in FIG. 12, the truncated pyramid 90 would slidably engage into the truncated recess 92 in the direction of arrows 95, as illustrated in FIG. 13A. It should be noted that for purposes of allowing a complete mating of the two members, and the allowance for any give and take between the two hull portions 12A and 12B, the truncated recess 92 is formed of a composite material, providing a compressible material 96 between its outer most metal surface 94, and its internal wall surface 97, to define the composite cushioned wall, so that when the truncated pyramid 90 mates within the space 92, the contact between the pyramid 90 and the metal surface 94 would be absorbed by the compressible material 96, upon impact. This composite layer of materials is seen in FIG. 13B where there is illustrated the interior truncated opening 92 formed in the wall 26. The compressible material 96 which is seen being inserted into the interior space of the opening 92, and upon there then the outer most metal skin 94 would be secured into the compressible material 96 for forming the composite layer of impact material, as seen in FIG. 13A. As stated earlier, this composite configuration of opening 92 would provide for a complete and cushioned mating between the two hulls 12A and 12B, so that they remain structurally firm while in the deep draft configuration.

It should be noted that in either configuration, whether it be in the configuration as seen in FIGS. 1 or 2, since the cargo holds 22 of the vessels are closed by the various side, top and bottom walls, cargo may be transported within the cargo holds 22 in either configuration. Also, a sea or river tug may be positioned along the aft portion of the vessel in either the deep draft configuration or the shallow draft configuration without having to alter that portion of the vessel.

The foregoing embodiments are presented by way of example only; the scope of the present invention is to be limited only by the following claims.

I claim:

1. A vessel, convertible between a deep draft configuration and a shallow draft configuration, comprising:

a. a principal hull portion, defined by side walls and top decks for defining cargo space therein;

b. a pair of center walls, dividing the hull portion into two separate hull portions and defining two cargo spaces along the length of the two hull portions;

c. a hinge member connecting the center walls along common edges, for allowing the center walls to move from a vertical position, wherein the two hull portions define a deep draft configuration, to a second non-vertical position wherein the hull portions define a shallow draft configuration; and d. means for the two hull portions to engage one another when in the deep draft configuration along a common surface to provide structural integrity to the two hull portions to function as a single hull vessel.

2. The vessel in claim 1, wherein the top decks further comprise openings for receiving and unloading cargo from the cargo spaces when the hulls are in either deep draft of shall draft configuration.

3. The vessel in claim 1, wherein the cargo spaces are further divided into smaller cargo holds or tanks by transverse bulkheads spaced apart along the length of each cargo space.

4. The vessel in claim 1, further comprising a means for assisting in moving the two hulls between the deep draft and shallow draft configurations.

5. The vessel in claim 4, wherein the means further comprises cables extending between upper portions of the hull portions for being retracted to move the hull portions to the deep draft configuration, and extended to move the hull portions to the shallow draft configuration.

6. A vessel, convertible between a deep draft configuration to a shallow draft configuration, comprising in the deep draft configuration:

a. a principal hull portion, defined by side walls and top deck for defining a cargo space therein;

b. vertically positioned center members together defining a center wall portion, defining two separate hull portions, and dividing the cargo space along the length of the vessel into first and second cargo spaces;

c. a hinge member connecting the center members along their lower common edges, so that in deep draft configuration the vessel defines a composite hull that is stable in deep, open-sea water;

d. and in the shallow draft configuration, the vertically positioned center members move away from one another about the hinge line, to a non-vertical position so that the two hull portions are able to traverse shallow water.

7. The vessel in claim 6, further comprising means to interlock surfaces of the center members when the center members are in the vertical, deep draft configuration.

8. The vessel in claim 6, further comprising means to allow the center members to travel between the vertical to the non-vertical positions in a controlled manner.

9. The vessel in claim 6, further comprising means for introducing ballast into a portion of each of the hull portions to assist the hull portions in moving from the shallow draft to the deep draft configuration.

10. The vessel in claim 6, further comprising hydraulic locking means for locking the two hull portions together as a single hull vessel, while the hull portions are in the deep draft configuration.

11. A vessel, convertible between a deep draft configuration and a shallow draft configuration, comprising:

a. a principal closed hull portion, for defining cargo space therein;

b. a pair of center walls extending the length of the principal hull portion, dividing the hull portion into two separate hull portions;

c. a hinge member connecting the center walls along common edges, for allowing the center walls to move between a vertical position, wherein the two hull portions define a deep draft configuration, and a second non-vertical position wherein the hull portions define a shallow draft configuration; and d. means for the two hull portions to engage one another when in the deep draft configuration along a common surface to provide structural integrity to the two hull portions to function as a single hull vessel.

12. The vessel in claim 11, wherein each of the hulls further comprises a top deck with openings for receiving and unloading cargo from cargo spaces when the hulls are in either deep draft of shall draft configuration.

13. The vessel in claim 11, wherein the cargo spaces are further divided into smaller cargo holds or tanks by transverse bulkheads spaced apart along the length of each hull.

14. The vessel in claim 11, wherein the assembly further comprises a cable extending between upper portions of the hull portions for allowing the cable to be retracted to move the hull portions to the deep draft configuration, and to be extended to move the hull portions to the shallow draft configuration.

15. The vessel in claim 11, further comprising means for introducing ballast into a portion of each of the hull portions to assist the hull portions in moving from the shallow draft to the deep draft configuration while the hull portions may be loaded with cargo.

16. The vessel in claim 11, further comprising hydraulic locking means for locking the two hull portions together as a single hull vessel, while the hull portions are in the deep draft configuration.

* * * * *